US009752390B2

(12) United States Patent
Steele

(10) Patent No.: US 9,752,390 B2
(45) **Date of Patent: *Sep. 5, 2017**

(54) CASING WINDOW ASSEMBLY

(71) Applicant: Halliburton Energy Services, Inc., Houston, TX (US)

(72) Inventor: David Joe Steele, Arlington, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/154,031

(22) Filed: May 13, 2016

(65) Prior Publication Data

US 2016/0251909 A1 Sep. 1, 2016

Related U.S. Application Data

(60) Continuation of application No. 14/615,820, filed on Feb. 6, 2015, now Pat. No. 9,366,116, which is a division of application No. 13/766,268, filed as application No. PCT/US2012/032093 on Apr. 2, 2012, now Pat. No. 9,033,059.

(51) Int. Cl.

| | |
|---|---|
| ***E21B 17/00*** | (2006.01) |
| ***E21B 29/06*** | (2006.01) |
| ***E21B 23/00*** | (2006.01) |
| ***E21B 47/024*** | (2006.01) |
| ***E21B 17/18*** | (2006.01) |
| ***E21B 43/10*** | (2006.01) |
| ***E21B 41/00*** | (2006.01) |

(52) U.S. Cl.

CPC ..... *E21B 17/00* (2013.01); *E21B 17/18* (2013.01); *E21B 23/004* (2013.01); *E21B 29/06* (2013.01); *E21B 41/0035* (2013.01); *E21B 43/10* (2013.01); *E21B 43/103* (2013.01); *E21B 47/024* (2013.01)

(58) Field of Classification Search

CPC ..... E21B 29/06; E21B 29/00; E21B 43/10; E21B 17/00; E21B 23/004; E21B 17/18; E21B 47/024; E21B 7/061; E21B 17/043; E21B 17/02; E21B 43/103; E21B 41/0035

See application file for complete search history.

(56) References Cited

U.S. PATENT DOCUMENTS

| | | | | |
|---|---|---|---|---|
| 7,073,599 | B2 * | 7/2006 | Smith | E21B 17/08 166/380 |
| 2009/0266544 | A1 * | 10/2009 | Redlinger | E21B 4/02 166/298 |
| 2013/0248174 | A1 * | 9/2013 | Dale | E21B 23/00 166/255.1 |

* cited by examiner

*Primary Examiner* — Yong-Suk (Philip) Ro

(74) *Attorney, Agent, or Firm* — Kilpatrick Townsend & Stockton LLP

(57) ABSTRACT

A casing window assembly for completion of a lateral wellbore. The casing window assembly includes a tubular casing sleeve with a casing window and an inner sleeve releasably secured within the casing sleeve at a pre-released position adjacent the casing window.

9 Claims, 4 Drawing Sheets

CASING WINDOW ASSEMBLY

CROSS-REFERENCE TO RELATED APPLICATIONS

This application is a continuation of U.S. patent application Ser. No. 14/615,820, filed on Feb. 6, 2015, which is a divisional of U.S. patent application Ser. No. 13/766,268, filed on Feb. 13, 2013, which claims the priority of PCT Patent Application Serial No. PCT/US2012/032093, filed on Apr. 2, 2012, and which are incorporated herein by reference.

STATEMENT REGARDING FEDERALLY SPONSORED RESEARCH

Not applicable.

FIELD OF THE INVENTION

The present invention generally relates to a casing window assembly and methods for installing the casing window assembly.

BACKGROUND OF THE INVENTION

Wellbores are typically drilled using a drilling string with a drill bit secured to the lower free end and then completed by positioning a casing string within the wellbore and cementing the casing string in position. The casing increases the integrity of the wellbore and provides a flow path between the surface and a selected subterranean formation for the injection of treating chemicals into the surrounding formation to stimulate production, for receiving the flow of hydrocarbons from the formation, and for permitting the introduction of fluids for reservoir management or disposal purposes.

During conventional milling and/or drilling operations, a casing window assembly may be used for completion of a lateral wellbore. A conventional casing window assembly generally includes a section of casing with a pre-milled window through the side of the casing for entry by a tool and an outer sleeve comprising aluminum connected around the pre-milled window to protect the annulus within the casing from debris and cement as the casing is secured within the wellbore. This type of casing window assembly, however, presents several disadvantages such as, for example, a larger outside diameter around the casing where the outer sleeve is connected, a lower pressure rating and it must be milled before drilling the lateral wellbore.

Other conventional casing window assembly designs include a section of casing with a pre-milled window through the side of the casing for entry by a tool and an inner steel sleeve connected to the pre-milled window to protect the inside of the casing from debris and cement as the casing is secured within the wellbore. Although this type of assembly provides a better seal for the pre-milled window and may have a higher pressure rating, it requires a separate trip to retrieve before drilling the lateral wellbore. This extra-separate trip to remove the inner sleeve can cost upwards of $100,000.00 to retrieve from a deep wellbore.

Other components of a conventional casing window assembly may include, for example, a mandrel for carrying a whipstock and/or a completion deflector and a separate orienting member secured below a pre-milled window in the casing for orienting the whipstock and/or the completion deflector at the proper lateral position and depth that is substantially the same lateral position and depth as the pre-milled window. The orienting member thus, orients the whipstock and/or completion deflector in order that the milling/drilling tool may enter the formation through the pre-milled window at the proper lateral position and depth. Because most conventional orienting members provide orientation both for a lateral position and depth at the same time, achieving a proper lateral position and depth in deeper wells can be time consuming and difficult due to the amount of torque imposed on the drilling string. In other words, as the drilling string is turned slowly from the top, the torque from turning the drilling string builds up and causes the bottom of the drilling string, where the whipstock and/or completion deflector are located, to turn rapidly in deeper applications. This often prevents finding the proper lateral position, which is not known until the torque is transmitted back up the drilling string.

SUMMARY OF THE INVENTION

The present invention overcomes one or more of the prior art disadvantages by using an improved casing window assembly to complete a lateral wellbore without milling through any part of the assembly.

In one embodiment the present invention includes a method for installing a casing window assembly, comprising: i) lowering the casing window assembly into a wellbore to a predetermined depth, the casing window assembly including a tubular casing sleeve with a position for a casing window and an inner sleeve releasably secured within the casing sleeve at a pre-released position adjacent the position for the casing window; ii) releasing the inner sleeve from the casing sleeve; and iii) releasably securing the inner sleeve within the casing sleeve at a post-released position below the position for the casing window.

These and other objects, features and advantages of the present invention will become apparent to those skilled in the art from the following description of the various embodiments and related drawings.

BRIEF DESCRIPTION OF THE DRAWINGS

The invention will be described with reference to the accompanying drawings, in which like elements are referenced with like reference numbers, and in which.

DETAILED DESCRIPTION OF THE REFERRED EMBODIMENTS

In the following detailed description of the preferred embodiments, reference is made to the accompanying drawings that form a part hereof, and in which is shown by way of illustration specific preferred embodiments in which the inventions may be practiced. These embodiments are described in sufficient detail to enable those skilled in the art to practice the invention, and it is to be understood that other embodiments that may be utilized and that logical changes may be made without departing from the spirit and scope of the present invention. The claimed subject matter thus, might also be embodied in other ways, to include structures, steps and combinations similar to the ones described herein, in conjunction with other present or future technologies. The following detailed description is therefore, not to be taken in a limiting sense, and the scope of the present invention is defined only the appended claims.

Figure 2:
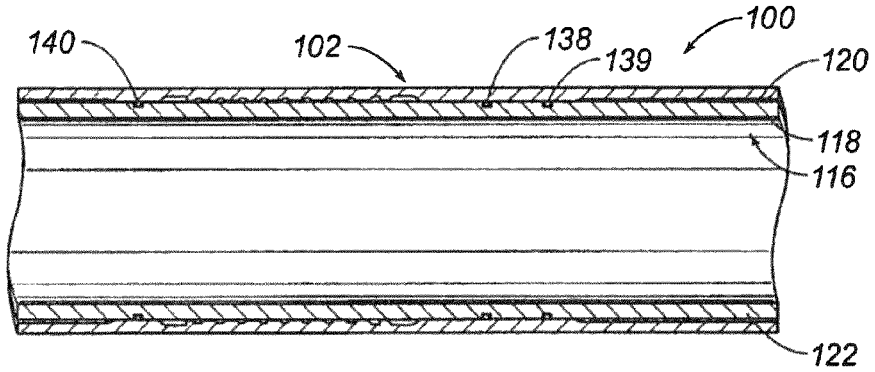
FIG. 2 is a cross-sectional view illustrating a middle section of the inner sleeve for the casing window assembly in FIG. 1.
Figure 3:
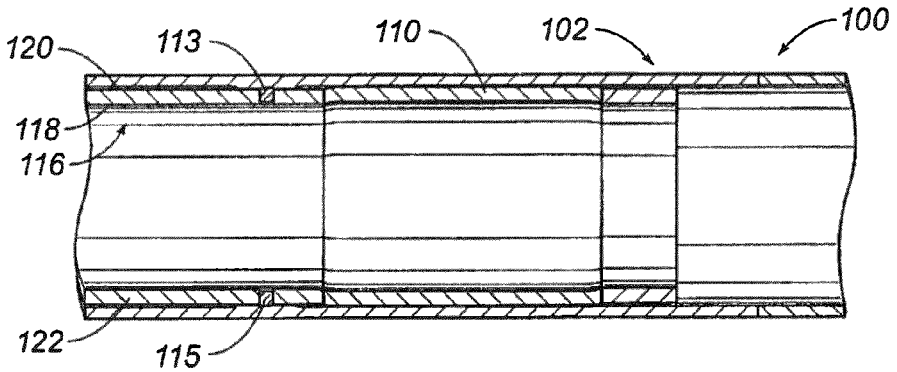
FIG. 3 is a cross-sectional view illustrating a lower end of the inner sleeve for the casing window assembly in FIG. 1.
Figure 4:
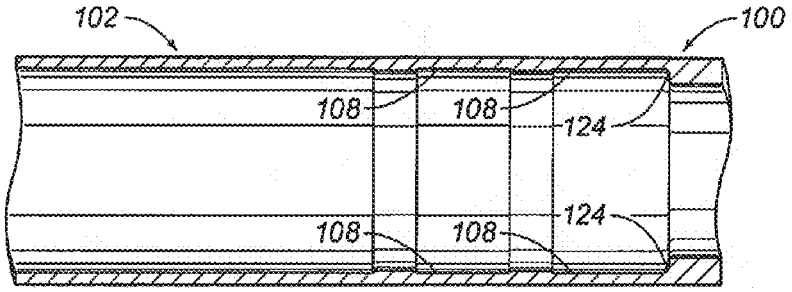
FIG. 4 is a cross-sectional view illustrating a lower end of a casing sleeve for the casing window assembly in FIG. 1.

Referring now to FIG. 14, a cross-sectional view illustrates one embodiment of an improved casing window assembly 100. The casing window assembly 100 includes an upper end of an inner sleeve 116 (FIG. 1), a middle section of the inner sleeve 116 (FIG. 2) and a lower end of the inner sleeve 116 (FIG. 3). The casing window assembly also includes a lower end of a tubular casing sleeve 102 (FIG. 4).

The casing sleeve 102 has an inside diameter 104, an outside diameter 106 and an opening between the inside diameter 104 and the outside diameter 106 forming a casing window, which may be pre-milled. The inside diameter 104 of the casing sleeve 102 includes a recessed wall profile 108 for receipt of a portion of an expandable wall 110 and a plurality of recesses for receipt of a portion of a respective securing element. The recessed wall profile 108 of the casing sleeve 102 and the expandable wall 110 are circumferential. The inner sleeve 116 is releasably secured within the casing sleeve 102 by the expandable wall 110 and/or one or more securing elements, and has an inside diameter 118, an outside diameter 120 and a wall 122 between the inside diameter 118 and the outside diameter 120. A portion of the wall 122 forms the expandable wall 110 and another portion of the wall 122 includes a portion of a securing element 112 and a portion of another securing element 113. The another portion of the wall 122 may further include a counter-securing element 114 and another counter-securing element 115 opposite the securing element 112 and opposite the another securing element 113, respectively. The securing element 112 and the counter-securing element 114 are preferably positioned above the casing window. The another securing element 113 and the another counter-securing element 115 are preferably positioned below the casing window. The number of securing elements may depend on a number of factors including, for example, the design of the casing window assembly 100 and the conditions under which it may be used.

The inside diameter 118 of the inner sleeve 116 includes a recessed wall portion 126 with an opening for receipt of the portion of the securing element 112 and a portion of the counter-securing element 114. The inner sleeve 116 is releasably secured to another inner sleeve 128 by a shear element 130 and/or by another shear element 131. The another inner sleeve 128 includes an outside diameter 132 with a recess 134 and another recess 135 for receipt of a portion of the securing element 112 and a portion of the counter-securing element 114, respectively.

Figure 1:
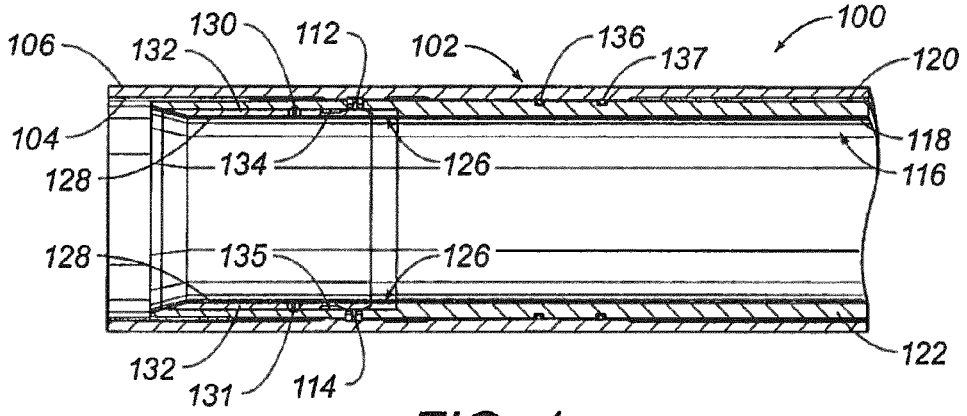
FIG. 1 is a cross-sectional view illustrating an upper end of an inner sleeve for one embodiment of a casing window assembly according to the present invention.

Each recess on the inside diameter 104 of the casing sleeve 102 and each respective securing element 112, another securing element 113, counter-securing element 114, and another counter-securing element 115 releasably secures the inner sleeve 116 within the casing sleeve 102 at a pre-released position as illustrated in FIG. 1. The expandable wall 110 and the recessed wall profile 108 of the casing sleeve 102 releasably secure the inner sleeve 116 within the casing sleeve 102 at a post-released position. The expandable wall 110 and recessed wall profile 108 may therefore, be designed to withstand a predetermined force to releasably secure the inner sleeve 116 within the casing sleeve 102 at the post-released position. An end of the recessed wall profile 108 includes a shoulder 124 as illustrated in FIG. 4. The shoulder 124 secures the inner sleeve 116 substantially near the post-released position when a force causes the inner sleeve 116 to release from the post-released position and move toward the shoulder 124.

The outside diameter 120 of the inner sleeve 116 includes a circumferential recess above the casing window for receipt of a seal 136 and another circumferential recess below the casing window for receipt of another seal 138. The seal 136 and the another seal 138 improve a high pressure rating for the casing window assembly 100 wherein each seal may be an O-ring or any other well known sealing element. Additional seals 137, 139 may be included to further improve the high-pressure rating of the casing window assembly 100. The casing window assembly 100 therefore, may be rated with a high pressure rating of at least 8,500 psi due to its unique design. Each seal 136, 137, 138, 139 and/or the inner sleeve 116 substantially prevent fluid communication between a main wellbore and within the inside of the casing sleeve 102 adjacent the casing window when the inner sleeve 116 is releasably secured at the pre-released position. In this manner, the area inside the casing sleeve 102 may be protected from debris and cement as the casing is secured within the main wellbore.

The casing window assembly 100 may be installed within a main wellbore by lowering the casing window assembly 100 into the main well bore to a predetermined depth. The inner sleeve 116 is releasably secured within the casing sleeve 102 in the pre-released position at the predetermined depth adjacent the casing window. The inner sleeve 116 may be released from the casing sleeve 102 by a downward force imposed by a tool on an end of the another inner sleeve 128 thus, shearing the shear element 130 and/or the another shear element 131 and causing the another inner sleeve 128 to release and travel downward within the recessed wall portion 126 until a portion of the securing element 112 and/or a portion of the counter-securing element 114 drop into the recess 134 and the another recess 135, respectively. In this manner, the securing element 112 and/or the another securing element 114 fall out of the recesses on the inside diameter 104 of the casing sleeve 102. Likewise, the another securing element 113 and the another counter-securing element 115 fall out of the recesses on the inside diameter 104 of the casing sleeve 102. Installation of the casing window assembly 100 may be completed by releasably securing the inner sleeve 116 within the casing sleeve 102 at the post-released position below the casing window. Once the inner sleeve 116 is released from the casing sleeve 102 in the manner thus described, the inner sleeve 116 travels downward within the casing sleeve 102 until the expandable wall 110 enters the recessed wall profile 108 of the casing sleeve 102 and expands thus, releasably securing the inner sleeve within the casing sleeve 102 at the post-released position below the casing window. In this manner, a separate trip into the main wellbore is not necessary to retrieve the inner sleeve 116. Alternatively, however, the inner sleeve 116 may be removed from the casing window assembly 100 in the main wellbore.

A bushing may be positioned within the recessed wall profile 108 of the casing sleeve 102 to prevent drill cuttings and/or other debris from settling in the recessed wall profile 108 and on the shoulder 124 that would prevent the inner sleeve 116 from moving to the post-released position. The bushing may be made from cardboard or some other well known compressible material that would prevent drill cuttings and/other debris from settling in the recessed wall profile 108 and on the shoulder 124 while permitting the inner sleeve 116 to compress or otherwise displace the bushing in order that inner sleeve 116 may travel to the post-released position.

Figure 5:
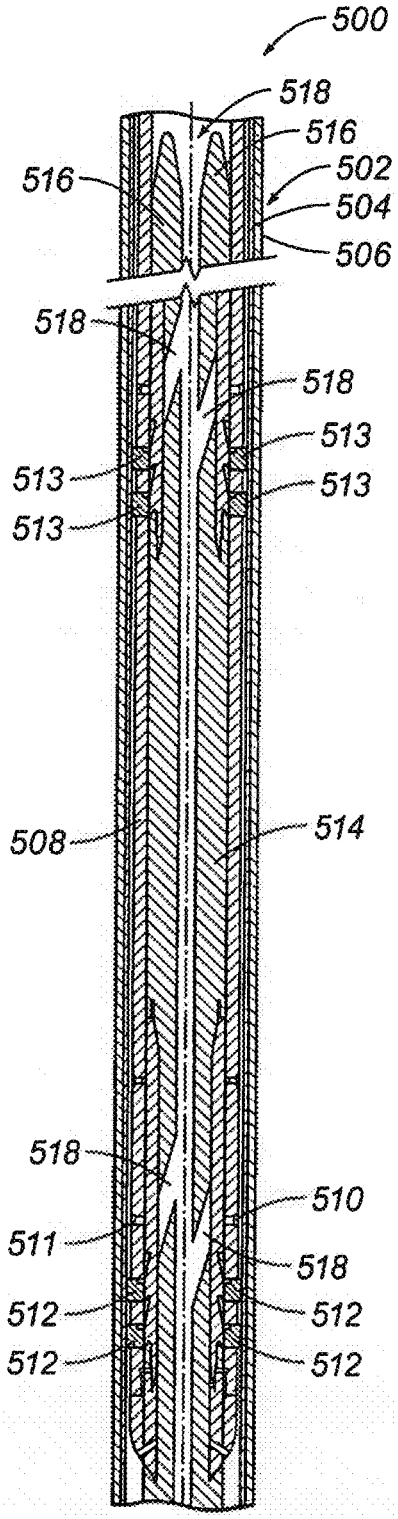
FIG. 5 is a cross-sectional elevation view illustrating a casing sleeve, a mandrel and an orienting member for another embodiment of a casing window assembly according to the present invention.

Once the casing window assembly 100 is installed, the casing window assembly 500 described in reference to FIGS. 5-6 may be used to orient a tool within the casing sleeve 102 at a lateral position that is substantially the same as the lateral position of the casing window and to lower the tool to a depth that is substantially the same as the depth of the casing window. Once the tool reaches the proper lateral position and depth, the tool may be positioned through the casing window when the inner sleeve 116 is releasably secured at the post-released position.

Referring now to FIG. 5, a cross-sectional elevation view illustrates another embodiment of an improved casing window assembly 500. The casing window assembly 500 includes a tubular casing sleeve 502, a mandrel 508 and an orienting member 514. The casing sleeve 502 has an inside diameter 504 and an outside diameter 506. The lower end of the mandrel 508 may include a plurality of expandable stop and orienting-keys 512. The plurality of expandable stop and orienting-keys 512 are preferably spring actuated or may be actuated by any other well known mechanical, electrical, hydraulic or other means.

The mandrel 508 has an upper end opposite the lower end. The upper end of the mandrel 508 may include another plurality of expandable stop and orienting-keys 513, depending on the preferred incremental orientation of the mandrel 508. The another plurality of expandable stop and orienting-keys 513 are preferably spring-actuated or may be actuated by any other well known mechanical, electrical, hydraulic or other means. The upper end of the mandrel 508 may also include a whipstock or a completion deflector positioned above the plurality of expandable stop and orienting-keys 512 and the another plurality of expandable stop and orienting-keys 513.

The orienting member 514 is secured within the casing sleeve 502 below the casing window, however, may be one integral component. The orienting member 514 includes a plurality of guiding elements 516 separated by a plurality of slots 518. The plurality of slots 518 include a plurality of orienting slots that direct the mandrel 508 to a lateral position that is substantially the same as the lateral position of the casing window and that permit the mandrel 508 to be lowered to a depth that is substantially the same as the depth of the casing window. Each of the plurality of expandable stop and orienting-keys 512 and each of the another plurality of expandable stop and orienting-keys 513 may be positioned within a respective one of the plurality of slots 518 upon contact with one of the plurality of guiding elements 516. The plurality of orienting slots therefore, first direct the mandrel 508 to the lateral position that is substantially the same as the lateral position of the casing window before permitting the mandrel 508 to be lowered to the depth that is substantially the same as the depth of the casing window. If the plurality of expandable stop and orienting-keys 512 and/or the another plurality of expandable stop and orienting-keys 513 are not properly aligned within the orienting slots, then the mandrel 508 cannot be lowered to the proper depth and must be rotated again until the plurality of expandable stop and orienting-keys 512 and the another plurality of expandable stop and orienting-keys 513 are properly aligned within the orienting slots. The proper lateral position for the mandrel 508 is thus, located to position the whipstock or completion deflector at a lateral position that is substantially the same as the lateral position of the casing window before lowering the mandrel 508, with the whipstock or completion deflector, to a depth that is substantially the same as the depth of the casing window. In this manner, the proper lateral position is conveniently determined without the delay associated with conventional orienting members caused by torque on the drilling string. The preferred number of the plurality of slots 518, including orienting slots, may depend on the preferred number of the plurality of expandable stop and orienting-keys 512 and/or the preferred number of the another plurality of expandable stop and orienting-keys 513.

Figure 6A:
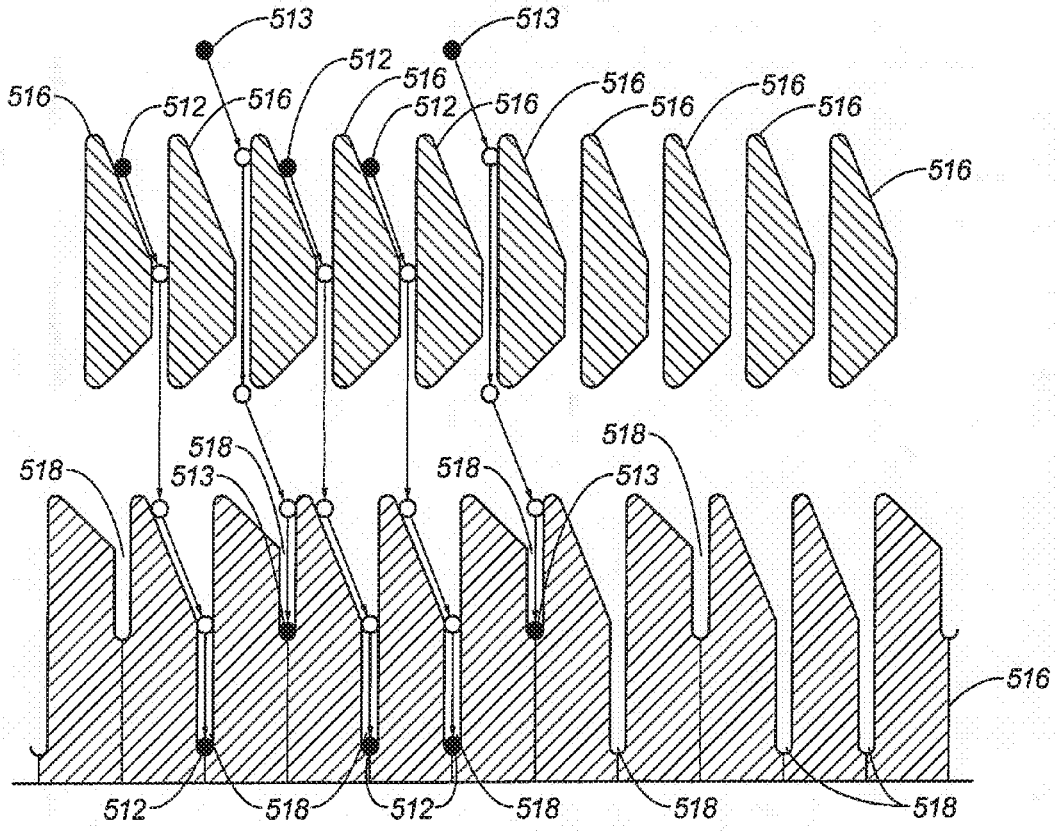
FIG. 6A is a schematic view illustrating the mandrel and the orienting member for the casing window assembly in FIG. 5 wherein the mandrel is positioned at a proper depth and orientation.

Referring now to FIG. 6A, a schematic view of the mandrel 508 and the orienting member 514 for the casing window assembly 500 is illustrated wherein the mandrel is positioned at a proper depth and orientation. For purposes of clarity, the paths of three of the plurality of expandable stop and orienting-keys 512 and two of the another plurality of expandable stop and orienting-keys 513 are illustrated. The plurality of slots 518 are equidistantly spaced around a circumference of the orienting member 514 in increments of 72°, however, may be spaced in any other preferred manner or increment. Because the mandrel 508 is aligned at a proper depth and orientation each of the three of the plurality of expandable stop and orienting-keys 512 are positioned within a respective one of the plurality of slots 518 that are referred to as the orienting slots.

Figure 6B:
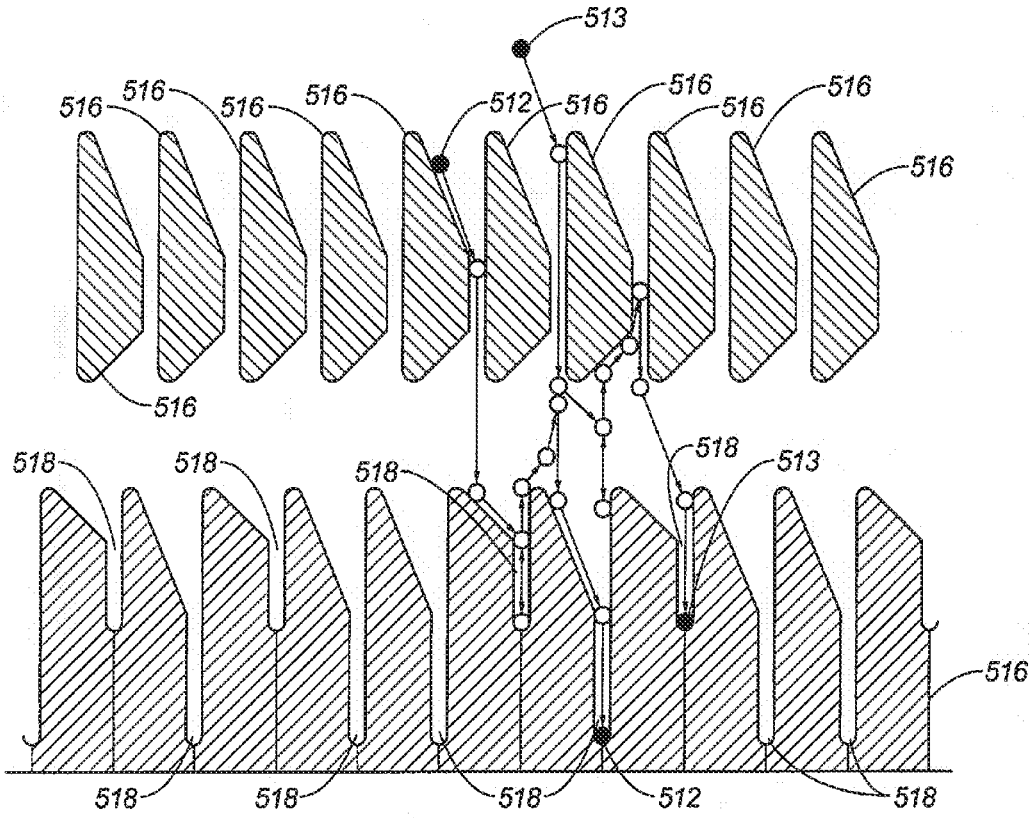
FIG. 6B is a schematic view illustrating the mandrel and the orienting member for the casing window assembly in FIG. 5 wherein the mandrel is rotated from an improper depth to a proper depth and orientation.

Referring now to FIG. 6B, a schematic view of the mandrel 508 and the orienting member 514 for the casing window assembly 500 is illustrated wherein the mandrel is rotated from an improper depth to a proper depth and orientation. Because the mandrel 508 is misaligned at an improper depth, it must be rotated axially upward once to index the mandrel 508 to a proper depth and orientation as illustrated by the path of one of the plurality of expandable stop and orienting-keys 512 and the path of one of the another plurality of expandable stop and orienting-keys 513. The design of the orienting member 514 and its plurality of guiding elements 516 may be referred to as an indexing or walking J slot configuration that allows the mandrel 508 to be effectively picked up and automatically indexed to the next one of the plurality of slots 518 for a new orientation until the proper depth and orientation are reached. If the next orientation is correct, then the mandrel 508 will move further downward providing an indication at the surface that the mandrel 508 is at the correct depth and orientation.

The invention claimed is:

1. A method for installing a casing window assembly, comprising:

lowering the casing window assembly into a main wellbore to a predetermined depth, the casing window assembly including a tubular casing sleeve with a position for a casing window and an inner sleeve releasably secured within the casing sleeve at a pre-released position adjacent the position for the casing window;

releasing the inner sleeve from the casing sleeve;

releasably securing the inner sleeve within the casing sleeve at a post-released position below the position for the casing window.

2. The method of claim 1, wherein the inner sleeve substantially prevents fluid communication between the wellbore and within the casing sleeve adjacent the position for the casing window when the inner sleeve is releasably secured at the pre-released position.

3. The method of claim 1, further comprising:

orienting a tool within the casing sleeve at a lateral position that is substantially the same as a lateral position of the position for the casing window; and lowering the tool to a depth that is substantially the same as a depth of the position for the casing window.

4. The method of claim 3, further comprising positioning another tool through the casing sleeve at the position for the casing window when the inner sleeve is releasably secured at the post-released position.

5. The method of claim 1, wherein the inner sleeve is releasably secured within the casing sleeve at the pre-released position by a securing element and a recess in an inside diameter of the casing sleeve for receipt of a portion of the securing element.

6. The method of claim 1, wherein the inner sleeve is releasably secured within the casing sleeve at the post-released position by an expandable wall and a recessed wall profile in an inside diameter of the casing sleeve for receipt of a portion of the expandable wall.

7. The method of claim 6, further comprising positioning a bushing within the recessed wall profile of the casing sleeve.

8. The method of claim 1, further comprising applying a force to cause the inner sleeve to release from the post-released position or the pre-released position.

9. The method of claim 8, wherein an end of the recessed wall profile includes a shoulder to secure the inner sleeve substantially near the post-released position when the force causes the inner sleeve to release from the post-released position or the pre-released position and move toward the shoulder.

* * * * *